United States Patent [19]

Bachot et al.

[11] Patent Number: 4,539,085

[45] Date of Patent: Sep. 3, 1985

[54] POROUS DIAPHRAGM FOR ELECTROLYTIC CELL

[75] Inventors: Jean Bachot, Fontenay aux Roses; Jean Grosbois, L'Isle Adam, both of France

[73] Assignee: Chloe Chimie, Puteaux, France

[21] Appl. No.: 558,585

[22] Filed: Dec. 6, 1983

Related U.S. Application Data

[62] Division of Ser. No. 378,222, May 14, 1982, Pat. No. 4,432,860.

[30] Foreign Application Priority Data

May 15, 1981 [FR] France ..... 81 09688

[51] Int. Cl.[3] ..... C25B 1/46; C25B 1/34; C25B 1/16; C25B 13/08

[52] U.S. Cl. ..... 204/98; 204/296; 204/252; 204/301

[58] Field of Search ..... 204/296, 98, 252, 301, 204/59 R; 427/407.1; 429/247; 521/27

[56] References Cited

U.S. PATENT DOCUMENTS

| | | | |
|---|---|---|---|
| 3,291,632 | 12/1966 | Nielsen | 204/296 |
| 3,694,281 | 9/1972 | Leduc | 204/296 |
| 3,853,721 | 12/1974 | Darlington et al. | 204/296 |
| 3,980,613 | 9/1976 | Bachot et al. | 204/296 |
| 4,003,818 | 1/1977 | Juillard et al. | 204/296 |
| 4,031,041 | 6/1977 | Bouy et al. | 204/296 |
| 4,135,996 | 1/1979 | Bouy et al. | 204/252 |
| 4,186,076 | 1/1980 | de Nora et al. | 204/296 |
| 4,204,938 | 5/1980 | Bachot et al. | 204/296 |
| 4,204,941 | 5/1980 | Niccolini | 204/296 |
| 4,341,615 | 7/1982 | Bachot et al. | 204/301 |
| 4,419,209 | 12/1983 | Klinkowski | 204/296 |

*Primary Examiner*—John F. Niebling
*Assistant Examiner*—B. J. Boggs, Jr.
*Attorney, Agent, or Firm*—Burns, Doane, Swecker & Mathis

[57] ABSTRACT

A porous diaphragm for an electrolytic cell enables, e.g., the electrolysis of NaCl to NaOH, in high concentration and in good yield, said diaphragm comprising an electrolytically acceptable porous sheet member having a total pore volume and average equivalent pore diameter adapted for electrolysis, and having an ion exchange resin fixedly deposited within the pores and occupying from 8 to 30% of the total pore volume thereof.

38 Claims, No Drawings

POROUS DIAPHRAGM FOR ELECTROLYTIC CELL

This application is a division of application Ser. No. 378,222, filed May 14, 1982, now U.S. Pat. No. 4,432,860.

BACKGROUND OF THE INVENTION

1. Field of the Invention

The present invention relates to a porous diaphragm for use in an electrolytic cell, and, more especially, to a porous diaphragm for use in an electrolytic cell to prepare, by electrolysis, high yields of concentrated solutions of alkali metal hydroxides.

2. Description of the Prior Art

It has very long been known to this art to produce chlorine and sodium hydroxide by electrolysis in electrolytic cells fitted with porous diaphragms. And also for a long period of time, such diaphragms were fabricated from asbestos; for the last several years various fluorinated resins were added to or substituted for the asbestos in order to provide diaphragms having improved physical properties. These fluorinated polymers and, in particular, polytetrafluoroethylene, nonetheless have the disadvantage of being difficult to wet with water or aqueous solutions, which hinders or even prevents the percolation of the cell electrolyte through the pores of the diaphragm. This disadvantage was remedied by depositing small amounts of carboxylic acid resins within the pores, as described in French Application No. 80/01843, and its U.S. counterpart application Ser. No. 226,693, now U.S. Pat. No. 4,341,615, as well as French Pat. No. 2,419,985 and its U.S. counterpart, i.e., U.S. Pat. No. 4,222,842. Described therein is the conversion of a porous diaphragm into an ion exchange separator, by the total obstruction of the pores of the diaphragm. The different separators have their own properties; while the diaphragms make it possible to prepare sodium hydroxide in low concentration and containing sodium chloride, the ion exchange separators almost entirely eliminate the presence of chloride in the product hydroxide which may be at a relatively high concentration, but which is obtained in but mediocre yields.

SUMMARY OF THE INVENTION

Accordingly, a major object of the present invention is the provision of an improved porous diaphragm for the preparation, by electrolysis, of alkali metal hydroxides in high concentrations and in excellent yields.

Briefly, the present invention features a diaphragm especially adapted for an electrolytic cell, said diaphragm comprising a porous sheet member, a portion of the total pore volume of which being filled with an ion exchange resin, with the percentage of the total pore volume occupied by said ion exchange resin ranging from 8 to 30%.

DETAILED DESCRIPTION OF THE INVENTION

More particularly according to the present invention, the total porosity is defined as the volume of free pores, together with the volume occupied by the ion exchange resin within the membranous diaphragm; the volume of the exchange resin occupying a portion of the pore volume is measured while the resin is in the dry state. The percentage of the pore volume occupied by resin swollen with the electrolyte varies over appreciable proportions as a function of various parameters (nature of the copolymer, composition of the electrolyte, temperature, and the like). The proportions of the dry resin above indicated are such that the pores are sufficiently open, while nonetheless having a specific internal structure when the resins are moistened.

The present invention also features a process for the preparation of the subject diaphragms, by affixing the resin within the pores of the diaphragm.

According to a first embodiment of the process of this invention, the ion exchange resin is directly prepared in situ within the pores of a preformed sheet or substrate.

The porous base sheet may be prepared by any one of a wide variety of different processes, a great number of which being well known to this art. Representative fluorinated resins advantageously utilized consistent herewith are specifically polytetrafluoroethylene (PTFE), polytrifluoroethylene, polyhexafluoropropylene, vinyl polyfluoride, vinylidene polyfluoride, polyperfluoroalkoxyethylene, the polyhalogenoethylenes containing one or two chlorine atoms and two or three fluorine atoms for each ethylene recurring unit and particularly the corresponding polychlorotrifluoroethylene and the polyhalogenopropylenes, copolymers of ethylene and/or propylene with unsaturated hydrocarbon halides having 2 or 3 carbon atoms, at least a fraction of the halogen atoms being fluorine atoms. Among such compounds, those commercially available under the trademarks "TEFLON" of DuPont de Nemours, "SOREFLON" of Societe Chimiques Ugine Kuhlmann, and "HALAR" of Allied Chemical Co. are especially noteworthy.

These resins may be reinforced with different fibers, whether mineral, such as asbestos, glass, quartz, zirconium or carbon fibers, or organic, such as fibers of polypropylene or polyethylene, optionally halogenated, specifically fluorinated, or of polyhalogenovinylidene fibers, and the like.

The proportion of the reinforcing fibers advantageously range from 0 to 200% by weight of the resin.

The total pore volume of the sheet should preferably range from 50 to 95%, and the average equivalent diameter of the pores advantageously ranges from 0.1 to 12 micrometers and preferably from 0.2 to 6 micrometers, with "equivalent diameter" being defined as the diameter of a theoretical cylindrical pore permitting the same speed of passage of a weakly viscous liquid therethrough under a predetermined pressure, as the real pore.

Among the preferred processes for the preparation of the porous base sheets, those featuring incorporation of pore-forming agents, such as those described in the French Pat. Nos. 2,229,739, 2,280,435, 2,280,609 and 2,314,214, are exemplary, and are hereby expressly incorporated by reference. It is also within the scope hereof (i) to introduce a pore-forming agent into a latex of a fluorinated resin, and specifically polytetrafluoroethylene containing a plasticizer (for example, 200 to 1,200 and preferably 500 to 900 parts by weight of the pore-forming agent, 0.5 to 2 parts by weight of plasticizer and 1 to 20 parts of water being added to 100 parts of the resinous latex containing 40 to 60% by weight of dry solids, (ii) to mix the combination in a moderately agitated malaxator, i.e., the rotor of which turning at a rate of less than 100 rpm, (iii) next forming, preferably by rolling, a sheet from the paste which results, and then (iv) drying said sheet and (v) sintering same at a temperature on the order of the melting point of the polymer employed. The pore-forming agent, which preferably consists of calcium carbonate, is then eliminated by immersion of the sheet in an acid, preferably in a 15 to 20% by weight aqueous solution of acetic acid.

Porous sheets may also be obtained, particularly in the case where the selected fluorinated polymer is a copolymer of ethylene and chlorotrifluoroethylene, or a latex of PTFE, reinforced with mineral or organic fibers (asbestos, zirconia, polyolefin fibers), by dispersing the polymer, with 5 to 50% by weight of fibers, in water or an electrolyte, containing, for example, 15% sodium hydroxide and 15% sodium chloride, to which a surface active agent is added. This suspension is then placed on a filter surface; such surface is advantageously a perforated cathode.

After draining and drying, the sheet formed as a result of the filtering is heated to between 260° and 360° C., depending upon the nature of the polymer and such temperature is maintained from 30 min to 1 hour.

The porous sheet formed in this manner is then impregnated with a composition comprising the comonomers, a polymerization initiator and, optionally, an inert diluent. Among the ion exchange resins suitable herefor, carboxylic acid resins are the preferred.

At least one of the comonomers employed is an olefinically unsaturated carboxylic acid, optionally esterified, specifically with methanol and ethanol, and at least one of the comonomers is a nonionic compound comprising at least one

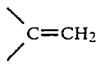

group, said group being borne, in particular, by a cycloaliphatic, aromatic, mono- or polycyclic, or heterocyclic parent nucleus.

The olefinically unsaturated carboxylic acid monomers employed typically comprise one or two carboxylic acid functions. Illustrative such monomers are acrylic and methacrylic acids and their halides derivatives, phenylacrylic, ethylacrylic, maleic, itaconic, butyl-acrylic, vinylbenzoic acids, and the like. Acrylic and methacrylic acid, or the methyl or ethyl ester derivatives thereof, are the preferred.

The nonionic comonomers may comprise but a single site of olefinic unsaturation, such as styrene, methylstyrene, ethylvinylbenzene, the chloro- or fluorostyrenes, or the chloro- or fluoromethylstyrenes, and also vinylpyridine or vinylpyrrolidone. Said comonomers may also comprise a plurality of olefinic double bonds, favoring the cross-linking of the polymer layer formed. Exemplary of these are the divinylbenzenes and particularly the para-isomer, which is preferred, trivinylbenzene, the divinylnaphthalenes, the divinylethyl- or divinylmethylbenzenes, 1,3,4-trivinylcyclohexane, and the like.

In one embodiment, it is preferred to simultaneously employ at least one nonionic olefinically monounsaturated and at least one olefinically polyunsaturated monomer. The numerical proportion of the molecules or units of these two types of monomers preferably ranges from 0.1 to 10, and more preferably from 0.4 to 2.5. The commercially available divinylbenzene/ethylvinylbenzene admixture is advantageously used.

The amount by weight of the unsaturated acid to the total amount of carboxylic acid and nonionic comonomers ranges from 65 to 90% by weight, and preferably the weight of the monomers is such that, for 100 parts of acid, 5 to 50 parts by weight of divinylbenzene are used; it is important that the aforedefined impregnating composition have a low viscosity, preferably less than 2 cP, such that it may penetrate, under a slight vacuum (1 to 100 mmHg under atmospheric pressure), into the pores of a microporous substrate. For this purpose, an inert diluent is advantageously added to the monomer mixture.

As examples of diluents, the following are representative: methanol, ethanol, isopropanol, the butanols, acetone, methylisobutylketone, dioxane, chloro- or dibromomethane, the aliphatic hydrocarbons, optionally halogenated and having 2 to 10 carbon atoms, dimethylformamide, dimethylacetamide, dimethylsulfoxide, and the like, with ethanol being the preferred inert diluent. In general, the diluents must have a relatively low vapor pressure at ambient temperature and a relatively high vapor pressure at polymerization temperatures, such that their evaporation is rapid; the boiling point of the diluents is preferably 10° to 20° C. greater than the temperature of polymerization. Same must also be miscible with the comonomers and optionally with water. For 100 parts by weight of the comonomers, preferably 25 to 400 and more preferably 70 to 150 parts by weight of diluent are used.

An initiator of free radical polymerization too is added to the mixture of the comonomers; in a general manner, an initiator may be employed that does not effect appreciable polymerization at ambient temperature in the absence of activating radiation (ultraviolet), but is capable of effecting polymerization of the monomers over a period of time preferably less than 12 hours, at a temperature less than the softening temperature of the fluorinated polymer employed, such temperature typically being less than 150° C. and preferably less than 100° C. The following polymerization initiators are exemplary: the benzoyl peroxides, lauroyl, t-butyl, cumyl peroxides, t-butyl peracetate or perbenzoate, as well as azobisisobutyronitrile.

The temperature conditions of polymerization may be adapted to the choice of the diluent such as to prevent its premature volatilization at the moment of the in situ polymerization. For this purpose, activators may be used, for example, dimethylaniline, which, combined with benzoyl peroxide, makes it possible to effect polymerization at about 40° C. to 70° C.

Thus, as above indicated, the amount of resin deposited within the pores may be regulated by the use of predetermined amount of the diluent; it may also be controlled by other means, such as the selection of the initiator of polymerization, the choice of the polymerization temperature, the addition of an accelerator, and the like.

The amount of the copolymer deposited should be such that in the dry state it occupies 8 to 30% of the total pore volume of the porous sheet and preferably from 10 to 20% thereof. The final porosity of the separator after deposition and moistening or swelling of the ion exchange resin should range from 20 to 90% and preferably from 50 to 80% of the initial porosity.

Ionic polymers, such as those described in French application No. 80/00195, may also be added to the aforesaid comonomers in solution; the ionic polymer used is preferably a chlorosulfonated polyethylene, having a Mooney viscosity of from 20 to 40, a sulfur content of 0.3 to 3.2% and a chlorine content of 15 to 50%, all by weight. Generally, for 100 parts by weight of the mixture of comonomers and the polymerization catalyst, 16 to 60, and preferably 30 to 50 parts by weight of the ionic polymer are added; it specifically plays the role of plasticizer. It should be noted that the above limits relative to the percentage of the total pore volume occupied by the copolymer also apply to the ionic polymer, if such is used.

The porous sheet, ultimately supported upon suitable support, and particularly on a cathode, is then introduced into an enclosure wherein the temperature, or actinic radiation, in particular ultraviolet irradiation, enable activation of the initiators of polymerization. Within the temperature limits noted hereinabove, a temperature is selected which does not give rise to appreciable changes in the structure of the microporous sheet by an excessively rapid evaporation of diluent, or to degradation of the copolymer deposited.

A preferred technique for polymerization is immersion of the sheet in water at a temperature of from 40° C. to 100° C.

A second embodiment of the process of the invention for the preparation of diaphragms consists of incorporating ion exchange resins, in powder form, into a fluorinated resin (in particular, a perfluorinated copolymer of ethylene and propylene), optionally reinforced with fibers, such as asbestos, the diaphragm itself being shaped from a suspension containing the aforementioned essential components. The ion exchange resin may be of sulfonic or carboxylic acid type, the backbones of which, from which the acid cation exchange functions depend, may themselves be fluorinated and may also comprise oxygen bridges.

The electrolytic process itself, which is the third object of the present invention, is thus effected by means of a diaphragm cell, the diaphragm of which being prepared as above and wherein the brine feedstream to the anodic compartment of said cell is preferably maintained at a concentration close to saturation under the conditions of use, or ranging from 4.6 to 5 moles for the sodium chloride per liter. The maintenance of the salt concentration is effected, for example, by the addition of said solid salt during the recycling of a portion of the anolyte removed via overflow means.

Very marked improvements in the yield of the electrolysis are obtained by the subject process, particularly if a high concentration of hydroxide in the catholyte is desired; this concentration is obtained by controlling the flow of the electrolyte through the diaphragm and, to effect this, the electrolyte potential (the difference in levels between the anolyte and the catholyte) is determined such as to maintain the concentration of the hydroxide at the value desired, when withdrawn.

In order to further illustrate the present invention and the advantages thereof, and to provide a comparison thereof with the known state of the art, the following specific examples are given, it being understood that same are intended only as illustrative and in nowise limitative.

COMPARATIVE EXAMPLE A (1) The following materials were placed into suspension in accordance with the process described in French Pat. No. 2,280,609:

(i) 800 parts by weight of calcium carbonate (marketed under the trademark OMYA);

(ii) 165 parts by weight of polytetrafluoroethylene, in the form of a latex having a solids content of 60% by weight (marketed under the trademark SOREFLON); and (iii) 42 parts by weight of dodecylbenzene sulfonate in the form of a 62 g/l aqueous solution.

This admixture was malaxated in a "Z" blade malaxator for 5 minutes at 45 rpm.

The paste which resulted was shaped into a sheet in a cylindrical mixer rotating at the speeds given below and with the spaces between the respective cylinders being as indicated:

| Speed of rotation | Distance between cylinders |
|---|---|
| 15 rpm | 3 mm |
| 10 rpm | 2.4 mm |
| 10 rpm | 1.8 mm |
| 10 rpm | 1.4 mm |
| 5 rpm | 1.0 mm |

A sheet was thus prepared having a thickness of 1.2 mm (±0.1 mm), which sheet was dried for 15 hours at 90° C. and for 2 hours at 120° C., then calcined by a gradual rise in the temperature thereof to 350° C., whereat it was maintained for 15 min in a circulating air furnace.

After cooling, the carbonate was eliminated by immersion of the sheet for 72 hours in an acetic acid solution, to which 2 g/l of a surface active agent marketed under the trademark of ZONYL F.S.N. by E. I. DuPont de Nemours were added. The porosity of the sheet was then on the order of 90% (pore volume was about 4 $cm^3/g$).

The diaphragm thus prepared was subsequently treated by filtering therethrough a mixture of:

(a) 330 parts by weight of ethanol;

(b) 100 parts by weight of methacrylic acid;

(c) 10 parts by weight of commercial divinylbenzene containing 55% by weight divinylbenzene and 45% by weight ethylvinylbenzene; and (d) 2 parts benzoyl peroxide.

Copolymerization of the mixture was then initiated in situ by immersion of the sheet for 2 hours in water at a temperature of 80° C.

The carboxylic acid copolymer thus formed in situ, and in the dry state, occupied 2% of the original pore volume.

(2) The diaphragm prepared in (1) above was next utilized in a filter-press type laboratory electrolytic cell.

The cathode was fabricated from braided rolled iron, and had an active surface of 0.5 $dm^2$.

The anode was expanded titanium coated with a Pt/Ir alloy; its active surface was also 0.5 $dm^2$.

Electrolysis was then carried out employing a current density of 25 $A/dm^2$, the cell being supplied with a 5.2 mole/liter sodium chloride brine, initially being at a temperature of 86° C.±1° C.

The rate of flow of the brine was initially 0.2 liter/hour, but was reduced to provide a sodium hydroxide solution in the cathodic department having an increasing concentration. The results of electrolysis are reported in Table I.

A comparable experiment was carried out in an electrolytic cell equipped with overflow means in the anodic compartment. The rate of flow of the supply of brine was regulated such that the concentration of sodium chloride in this compartment was maintained essentially at 4.8 mole/liter. The concentration of sodium in the cathodic compartment was regulated by adjusting the height of the overflow means and thus the height of the anolyte in the anode compartment and, consequently, the velocity of the flow of the electrolyte through the diaphragm. The results obtained are also reported in Table I. It will be appreciated that in this experiment the titer of sodium hydroxide was relatively high, but the yield remained low.

TABLE I

| | | | | | |
|---|---|---|---|---|---|
| Sodium hydroxide concentration (g/l) | | 100 | 125 | 150 | 180 |
| Faraday yield in % | First Experiment | 92 | 85 | <70 | — |
| | Second Experiment | 95 | 92 | 84 | 72.5 |

COMPARATIVE EXAMPLE B

A diaphragm prepared as in Comparative Example A was impregnated with water and then immersed in methanol. The following mixture was subsequently filtered therethrough:

(i) 100 parts by weight methacrylic acid;
(ii) 30 parts by weight commercial divinylbenzene;
(iii) 2 parts benzoyl peroxide; and
(iv) 1 part of dimethylaniline.

The resulting sheet was then immersed in water at a temperature of 60° C. for 1 hour, then in water at a temperature of 100° C. for 1 hour and finally in 5N sodium hydroxide at ambient temperatue for 12 hours, prior to being mounted in the electrolytic cell described in Comparative Example A.

The thickness of the separator deposited was 1.3 mm. The carboxylic acid copolymer, in the dry state, occupied 62% of the original pore volume. After swelling, in contact with the electrolyte, the total pore volume of the membrane was occupied by the copolymer, or, stated differently, the separator was impermeable or impervious to liquids.

The results of electrolysis, while maintaining a concentration of 4.8 mole/liter of sodium chloride in the anolyte, are reported in Table II.

TABLE II

| | | | | |
|---|---|---|---|---|
| Sodium hydroxide concentration (g/l) | 120 | 200 | 300 | 380 |
| Faraday yield (%) | 62 | 54 | 51 | 50 |
| $Cl^-$ ion per liter of catholyte | <0.1 | <0.1 | <0.1 | <0.1 |
| Potential (volts) | 3.3 | 3.3 | 3.3 | 3.3 |

EXAMPLE 1

The porous diaphragm prepared by the process described in Comparative Example A was treated as in Comparative Example B, but the copolymerization admixture was diluted with ethanol in a proportion of 45 parts by weight of the ethanol per 55 parts of the admixture of comonomers and additives. Copolymerization was then carried out as in Comparative Example A. The final thickness of the product membranous separator was 1.25 mm. The dry copolymer occupied 12% of the total pore volume. After swelling in contact with the electrolyte, this percentage increased, but without completely closing or blocking the pores.

Electrolysis was next performed, as in Comparative Example A, part (2), while maintaining a concentration of 4.6 to 4.8 mole/liter of sodium chloride in the anolyte. The following results were obtained:

TABLE III

| | | | | | | |
|---|---|---|---|---|---|---|
| NaOH, g/l | 100 | 125 | 150 | 180 | 200 | 250 |
| Potential, volts | 3.30 | 3.25 | 3.25 | 3.25 | 3.25 | 3.25 |
| Faraday yield | 96 | 94 | 91 | 86 | 82 | 70 |

EXAMPLE 2

The porous diaphragm was the same as in Example 1, but its thickness was increased to 1.85 mm. The dry copolymer occupied 12% of the total pore volume.

The electrolysis, again performed under the same conditions, provided the following even better results:

TABLE IV

| | | | | | | |
|---|---|---|---|---|---|---|
| NaOH, g/l | 100 | 125 | 150 | 180 | 200 | 230 |
| Potential, volts | 3.35 | 3.40 | 3.40 | 3.40 | 3.40 | 3.40 |
| Faraday yield | 98–99 | 97 | 95–96 | 93–94 | 92 | 89 |

EXAMPLES 3 AND 4

The porous diaphragm employed was the same as in Example 2, but the amount of divinylbenzene was 20 parts (Example 3) and 40 parts (Example 4) per 100 parts of the methacrylic acid. The dry polymer occupied, respectively, 8% (Example 3) and 14% (Example 4) of the total pore volume thereof.

The following Table V summarizes the results obtained:

TABLE V

| | NaOH, g/l | 100 | 125 | 150 | 180 | 200 | 230 |
|---|---|---|---|---|---|---|---|
| Ex. 3 | Δv Volts | 3.40 | 3.35 | 3.35 | 3.35 | 3.35 | 3.35 |
| | Yield, % | 97 | 95–96 | 93–94 | 90–91 | 88–89 | 85 |
| Ex. 4 | Δv Volts | 3.50 | 3.45 | 3.45 | 3.45 | 3.45 | 3.45 |
| | Yield, % | 99 | 98–99 | 97–98 | 95–96 | 94 | 91–92 |

EXAMPLE 5

In this example, the inventive concept was used to modify the performance of a diaphragm having controlled porosity, deposited under vacuum upon an iron cathode according to French Pat. No. 2,223,739.

A suspension of asbestos fibers containing the following materials was prepared:

(i) 66 parts of short asbestos fibers (Type $H_2$ of the HOOKER Co.);
(ii) 33 parts of long asbestos fibers (Type $H_1$ of the HOOKER Co.);
(iii) 2 parts of sodium dioctylsulfosuccinate, 65% in alcohol; and
(iv) 3300 parts of water.

Dispersion was carried out for 45 min using a rotating agitator (1350 rpm).

The following materials were then added thereto:

(v) 166 parts of PTFE latex (Trademark SOREFLON, 60% dry solids); and
(vi) 460 parts of $CaCO_3$ (Trademark BLE OMYA).

Agitation/dispersion was repeated for 45 min under similar conditions.

The cathode, consisting of a 70×70×22 mm "glove finger" of braided and rolled lattice was immersed in the suspension. Impregnation was then carried out under vacuum.

After draining and drying overnight at 150° C., the "cathode-deposition" assembly was heated at 310° C. for 15 min and then at 360° C. for 15 min.

At this point, the calcium carbonate was eliminated by immersion in 20% acetic acid, inhibited with 2% phenylthiourea, for 4 days.

The weight of the diaphragm was 1.3 kg/m$^2$ (metal excluded) and its total pore volume was approximately 2.5 cm$^3$/g.

The "diaphragm-cathode" assembly was then treated as in Example 1 in a proportion of 40 parts ethanol per 60 parts of the admixture of comonomers and additives. The dry polymer occupied 12% of the total pore volume.

This diaphragm, together with an untreated sample, were used in an electrolysis cell operating under the conditions described above. The results were as follows:

TABLE VI

| | NaOH, g/l | 100 | 125 | 150 | 180 | 200 |
|---|---|---|---|---|---|---|
| Control | Δv Volts | 3.15 | 3.15 | 3.15 | 3.15 | 3.15 |
| | Yield, % | 93 | 89 | 85 | 78 | 74 |
| Treated according to invention | Δv Volts | 3.20 | 3.20 | 3.20 | 3.20 | 3.20 |
| | Yield, % | 95 | 92 | 90 | 86 | 83 |

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. In an electrolyzing process carried out in an electrolytic cell comprising a porous diaphragm, the improvement which comprises utilizing as the diaphragm therefor, a porous diaphragm comprising an electrolytically acceptable porous sheet member having a total pore volume and average equivalent pore diameter adapted for electrolysis, and having an ion exchange resin fixedly deposited within the pores and occupying from 8 to 30% of the total pore volume thereof.

2. The process as defined by claim 1, the total pore volume of the diaphragm thereof ranging from 50 to 95%.

3. The process as defined by claim 2, the average equivalent pore diameter of the diaphragm ranging from 0.1 to 12 micrometers.

4. The process as defined by claim 3, the average equivalent pore diameter of the diaphragm ranging from 0.2 to 6 micrometers.

5. The process as defined by claim 1, said porous sheet member comprising a fluorinated resin.

6. The process as defined by claim 5, said fluorinated resin comprising a fluorocarbon.

7. The process as defined by claim 5, said fluorinated resin being fiber reinforced.

8. The process as defined by claim 1, said ion exchange resin being a polymerized, olefinically unsaturated carboxylic acid, or lower alkyl ester thereof.

9. The process as defined by claim 1, said ion exchange resin being a copolymer of an olefinically unsaturated carboxylic acid or lower alkyl ester thereof, and an olefinically unsaturated nonionic comonomer copolymerizable therewith.

10. The process as defined by claim 7, said nonionic comonomer comprising admixture of olefinically mono- and polyunsaturated nonionic comonomers.

11. The process as defined by claim 10, the molar ratio between said nonionic comonomers ranging from 0.1/1 to 10/1.

12. The process as defined by claim 9, said acid comonomer being acrylic or methacrylic acid, or methyl or ethyl ester thereof.

13. The process as defined by claim 9, said carboxylic acid comprising from 65 to 90% of the total amount by weight of the comonomers.

14. The process as defined by claim 1 said ion exchange resin being cross-linked.

15. The process as defined by claim 1, said ion exchange resin, when hydrated, occupying from 20 to 90% of said total pore volume.

16. The process as defined by claim 15, said ion exchange resin, when hydrated, occupying from 50 to 80% of said total pore volume.

17. The process as defined by claim 1, said ion exchange resin occupying from 10 to 20% of said total pore volume.

18. The process in accordance with claim 1, wherein alkali metal hydroxides are produced from alkali metal halides.

19. The process in accordance with claim 18, wherein sodium hydroxide is produced from sodium chloride.

20. The process in accordance with claim 18, wherein a brine feedstream to an anodic compartment of said cell is maintained at a concentration close to saturation under the conditions of use.

21. The process in accordance with claim 18, wherein the electrolyte potential of said cell is maintained so as to maintain the concentration of said hydroxide at the value desired, when withdrawn from said cell.

22. In an electrolytic cell comprising a porous diaphragm, the improvement which comprises utilizing as the diaphragm therefor, a porous diaphragm comprising an electrolytically acceptable porous sheet member having a total pore volume and average equivalent pore diameter adapted for electrolysis, and having an ion exchange resin fixedly deposited within the pores and occupying from 8 to 30% of the total pore volume thereof.

23. The electrolyte cell as defined by claim 22, the total pore volume of the diaphragm thereof ranging from 50 to 95%.

24. The electrolytic cell as defined by claim 23, the average equivalent pore diameter ranging from 0.1 to 12 micrometers.

25. The electrolytic cell as defined by claim 24, the average equivalent pore diameter ranging from 0.2 to 6 micrometers.

26. The electrolytic cell as defined by claim 22, said porous sheet member comprising a fluorinated resin.

27. The electrolytic cell as defined by claim 26, said fluorinated resin comprising a fluorocarbon.

28. The electrolytic cell as defined by claim 26, said fluorinated resin being fiber reinforced.

29. The electrolytic cell as defined by claim 22, said ion exchange resin being a polymerized, olefinically unsaturated carboxylic acid, or lower alkyl ester thereof.

30. The electrolytic cell as defined by claim 22, said ion exchange resin being a copolymer of an olefinically unsaturated carboxylic acid or lower alkyl ester thereof, and an olefinically unsaturated nonionic comonomer copolymerizable therewith.

31. The electrolytic cell as defined by claim 30, said nonionic comonomer comprising admixture of olefinically mono- and polyunsaturated nonionic comonomers.

32. The electrolytic cell as defined by claim 31, the molar ratio between said nonionic comonomers ranging from 0.1/1 to 10/1.

33. The electrolytic cell as defined by claim 30, said acid comonomer being acrylic or methacrylic acid, or methyl or ethyl ester thereof.

34. The electrolytic cell as defined by claim 22, said carboxylic acid comprising from 65 to 90% of the total amount by weight of the comonomers.

35. The electrolytic cell as defined by claim 22, said ion exchange resin being cross-linked.

36. The electrolytic cell as defined by claim 22, said ion exchange resin, when hydrated, occupying from 20 to 90% of said total pore volume.

37. The electrolytic cell as defined by claim 36, said ion exchange resin, when hydrated, occupying from 50 to 80% of said total pore volume.

38. The electrolytic cell as defined by claim 22, said ion exchange resin occupying from 10 to 20% of said total pore volume.

* * * * *